US011589167B1

(12) United States Patent
Xiao et al.

(10) Patent No.: US 11,589,167 B1
(45) Date of Patent: Feb. 21, 2023

(54) MULTIFUNCTIONAL ELECTROMAGNETIC TRANSDUCER

(71) Applicant: AAC Microtech (Changzhou) Co., Ltd., Changzhou (CN)

(72) Inventors: Bo Xiao, Shenzhen (CN); Ronglin Linghu, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/562,008

(22) Filed: Dec. 27, 2021

(30) Foreign Application Priority Data

Nov. 10, 2021 (CN) ..... 202122738440.5

(51) Int. Cl.
*H04R 9/02* (2006.01)
*H04R 9/06* (2006.01)
*H04R 1/02* (2006.01)

(52) U.S. Cl.
CPC ..... *H04R 9/025* (2013.01); *H04R 1/025* (2013.01); *H04R 9/06* (2013.01)

(58) Field of Classification Search
CPC ..... H04R 9/025; H04R 1/025; H04R 9/06
USPC ..... 381/396
See application file for complete search history.

(56) References Cited

U.S. PATENT DOCUMENTS

| | | | | |
|---|---|---|---|---|
| 5,894,263 | A * | 4/1999 | Shimakawa | G08B 6/00 340/407.1 |
| 6,850,138 | B1 * | 2/2005 | Sakai | H04R 9/06 340/388.5 |
| 7,324,655 | B2 * | 1/2008 | Sato | H04R 5/033 381/396 |
| 7,525,403 | B2 * | 4/2009 | Kim | B06B 1/045 335/229 |
| 2018/0213329 | A1 * | 7/2018 | Kang | H04R 9/046 |

* cited by examiner

*Primary Examiner* — Sean H Nguyen
(74) *Attorney, Agent, or Firm* — W&G Law Group

(57) ABSTRACT

The present invention provides a multifunctional electromagnetic transducer including: a housing providing with a sound port and a speaker fixed with the housing. The speaker includes a frame forming an accommodating cavity cooperatively with the housing, a vibration system supported on the frame and received in the accommodating cavity; and a magnetic circuit system received in the accommodating cavity driving the vibration system to vibrate along a first direction and generate sounds. The multifunctional electromagnetic transducer further includes a flexible support disposed on a side of the magnetic circuit system distal to the vibration system and secured to the housing. The magnetic circuit system is suspended in the accommodating cavity by the flexible support and moves along the first direction.

10 Claims, 5 Drawing Sheets

B-B

A-A

B-B

MULTIFUNCTIONAL ELECTROMAGNETIC TRANSDUCER

FIELD OF THE PRESENT INVENTION

The present invention relates to an electromagnetic transducer, and more particularly, to a multifunctional electromagnetic transducer.

DESCRIPTION OF RELATED ART

With the rapid development of wireless communication technologies, mobile phone and other consumer electronic products are widely used. The multifunctional electromagnetic transducers are also known as speakers or horns, and are often used in these products. Specifically, they are used in speaker boxes to convert electrical signals into sound for playback.

With the rapid development of electronic technology, portable consumer electronic devices are becoming more and more popular, such as mobile phones, handheld game consoles, navigation devices or handheld multimedia entertainment devices, etc. These electronic devices generally use voice and/or vibration to provide system feedback, such as call reminder of mobile phone, navigation reminder, game console vibration feedback, etc. In related art, the vibration feedback and the voice feedback of the electronic device are respectively completed by different devices, which is not conducive to the reduction of the volume of the electronic device. Even a multifunctional sounding device that integrates different functions requires a long time for vibration response, and the user experience is not good.

Therefore, it is desired to provide a new multifunctional electromagnetic transducer which can overcome the above problems.

SUMMARY

In view of the above, the embodiment of the present invention provides a new multifunctional electromagnetic transducer. By the present invention, the multifunctional electromagnetic transducer has a fast response speed.

The present invention provides a multifunctional electromagnetic transducer including: a housing providing with a sound port and a speaker fixed with the housing. The speaker includes a frame forming an accommodating cavity cooperatively with the housing, a vibration system supported on the frame and received in the accommodating cavity; and a magnetic circuit system received in the accommodating cavity driving the vibration system to vibrate along a first direction and generate sounds. The multifunctional electromagnetic transducer further includes a flexible support disposed on a side of the magnetic circuit system distal to the vibration system and secured to the housing. The magnetic circuit system is suspended in the accommodating cavity by the flexible support and moves along the first direction.

As an improvement, the magnetic circuit system comprises a yoke and a magnet assembly mounted on the yoke, the yoke comprising a main portion supporting the magnet assembly and an extension portion bending and extending from the main portion to the flexible support and secured to the flexible support, the magnetic circuit system fixed with the flexible support through the extension portion.

As an improvement, the housing comprises an upper cover mounted on a side of the frame, a middle cover mounted on an opposite side of the frame, and a lower cover fixed on a side of the middle cover distal to the upper cover, the flexible support comprising a fixing portion sandwiched between the middle cover and the lower cover and an elastic portion extending from the fixing portion into the accommodating cavity, the elastic portion connecting with the extension portion.

As an improvement, each of two ends of the main portion respectively extends to form the extension portion along a second direction perpendicular to the first direction, the flexible support having two elastic portions corresponding to the extension portions, the extension portion and the corresponding elastic portion fixed in one-to-one.

As an improvement, the extension portion comprises a first extension portion bending and extending from the main portion to a direction of the flexible support and a second extension portion bending and extending from the first extension portion and fixing to the elastic portion.

As an improvement, an outer surface of the housing is level with an outer surface of the frame.

As an improvement, an end of the middle cover proximal to the lower cover turns over into the accommodating cavity to form a flange, and the fixing portion is fixedly connected between the flange and the lower cover.

As an improvement, the flange and the fixing portion are both with an annular shape.

As an improvement, the vibration system comprises a diaphragm secured to the frame, an elastic assembly spaced apart from the diaphragm and mounted between the frame and the housing, a connection support connecting the diaphragm and the elastic assembly, and a voice coil fixing with the connection support, the magnetic circuit system comprising a main magnet and a plurality of auxiliary magnets, the auxiliary magnets arranged at two ends of the main magnet and spaced apart from the main magnet for forming a magnetic gap, the voice coil at least partially located in the magnetic gap.

As an improvement, the connection support comprises a first bending portion secured to the diaphragm, a second bending portion bending and extending from the first bending portion to the elastic assembly, and a third bending portion bending and extending from the second bending portion and secured to the elastic assembly, the voice coil fixing to a side of the third bending portion away from the elastic assembly.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present invention. Moreover, in the drawings, like reference numerals designate corresponding parts throughout the several views.

DETAILED DESCRIPTION OF THE EXEMPLARY EMBODIMENT

Figure 1:
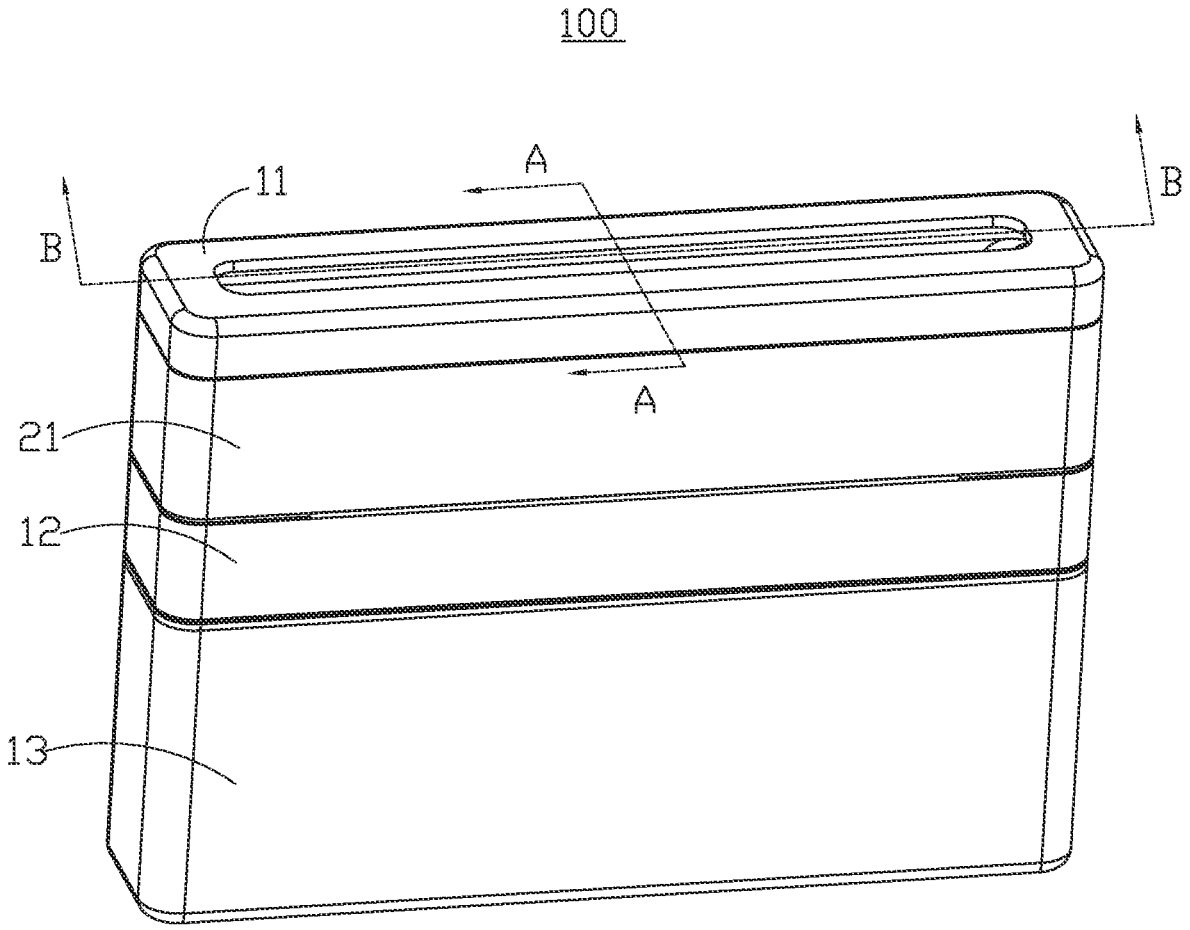
FIG. 1 is an illustrative isometric view of a multifunctional electromagnetic transducer in accordance with one embodiment of the present invention.
Figure 2:
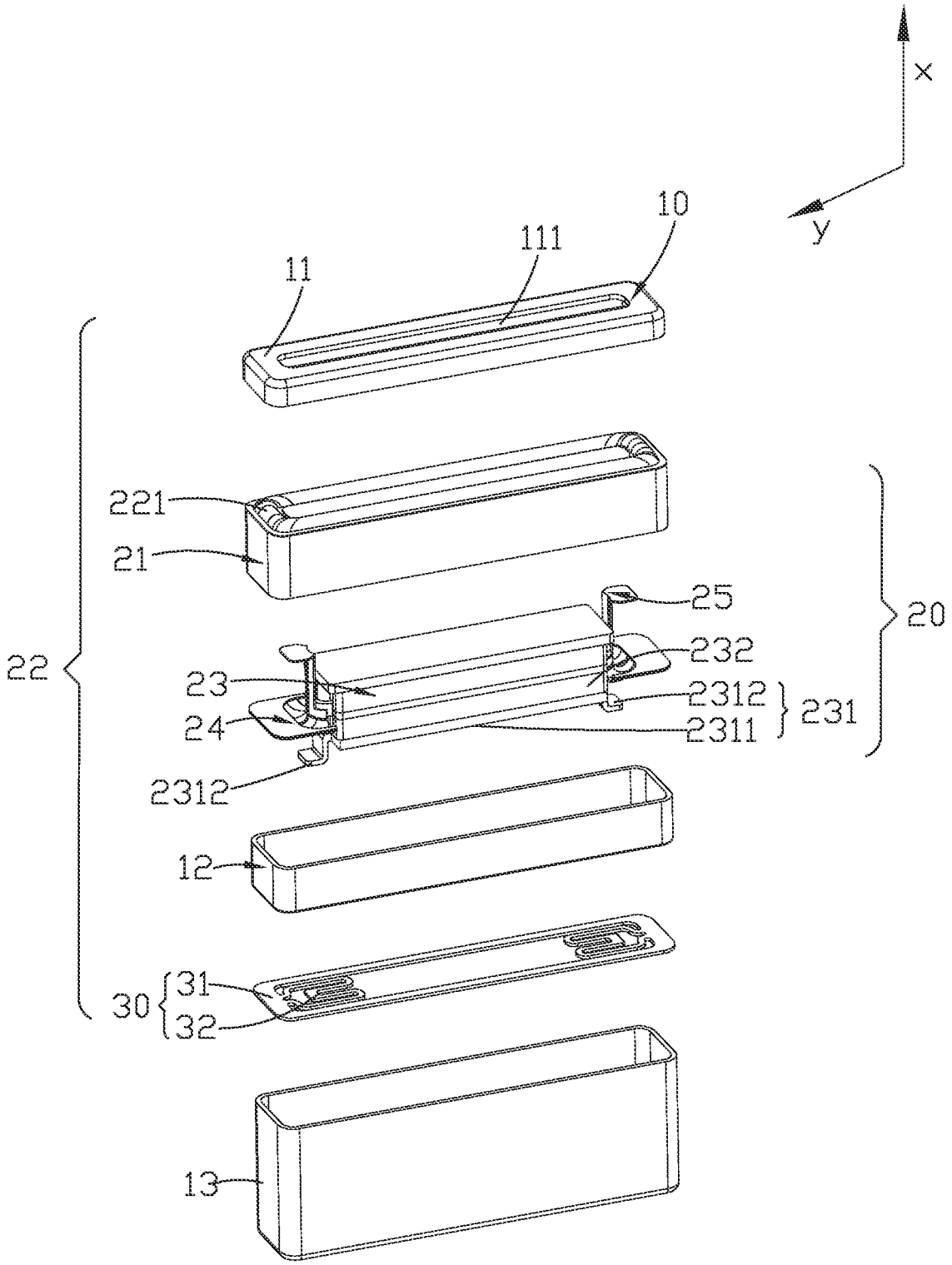
FIG. 2 is an exploded view of the multifunctional electromagnetic transducer of FIG. 1.

The present invention will hereinafter be described in detail with reference to exemplary embodiments. To make the technical problems to be solved, technical solutions and beneficial effects of the present invention more apparent, the present invention is described in further detail together with the figures and the embodiments. It should be understood the specific embodiments described hereby is only to explain the disclosure, not intended to limit the disclosure.

Referring to the FIGS. 1-5, the present invention provides one embodiment of a multifunctional electromagnetic transducer 100. The multifunctional electromagnetic transducer 100 enables generating both sound and vibration. The multifunctional electromagnetic transducer 100 includes a housing 10 providing with a sound port 111 and a speaker 20 fixed with the housing 10. The speaker 20 is received in the housing 10. The speaker 20 includes a frame 21, a vibration system 22 supported on the frame 21, and a magnetic circuit system 23 supported on the frame 21. The magnetic circuit system 23 drives the vibration system 22 to vibrate along a first direction and generate sounds. The first direction is a direction indicated by arrow x in FIG. 2. The housing 10 and the frame 21 cooperatively form an accommodating cavity 101 for receiving the vibration system 22 and magnetic circuit system 23. The multifunctional electromagnetic transducer 100 further includes a flexible support 30 disposed on a side of the magnetic circuit system 23 distal to the vibration system 22 and secured to the housing 10. The magnetic circuit system 23 is fixed with the flexible support 30 is suspended in the accommodating cavity 101 by the flexible support 30, and the magnetic circuit system 23 moves along the first direction. The first direction is the sounding direction of the speaker 20.

In some embodiments, the multifunctional electromagnetic transducer 100 has a rectangular structure. And in other embodiments, the multifunctional electromagnetic transducer can also be set to a cube or other three-dimensional structures, and it can be adjusted according to different usage environments.

The magnetic circuit system 23 comprises a yoke 231 and a magnet assembly 232 mounted on the yoke 231. The yoke 231 comprising a main portion 2311 supporting the magnet assembly 232 and an extension portion 2312 bending and extending from the main portion 2311 to the flexible support 30 and secured to the flexible support 30. The magnetic circuit system 23 is fixed with the flexible support 30 through the extension portion 2312. While the magnetic circuit system 23 drives the vibration system 22 to vibrate along the first direction, the magnetic circuit system 23 can also vibrate along a vibration direction of the vibration system 22 under the support of the flexible support 30, thereby obtaining a stronger motor driving force and resistance. Both the starting time and the braking time are greatly shortened to achieve a better vibration experience.

It should be noted that the multifunctional electromagnetic transducer can have different functions due to the different passing currents. In one working condition, the multifunctional electromagnetic transducer can be used as a loudspeaker to realize the function of sound when passing in high-frequency current, and in another working condition, the multifunctional electromagnetic transducer can be used as a vibration motor when passing in low-frequency current. Under the support of the flexible support 30, the starting time and the braking time of the vibration motor are greatly shortened to achieve a better vibration experience.

The housing 10 comprises an upper cover 11 mounted on a side of the frame 21, a middle cover 12 mounted on an opposite side of the frame 21, and a lower cover 13 fixed on a side of the middle cover 12 distal to the upper cover 11. The upper cover 11 is a hollow structure, and the sound port 111 is disposed on the upper cover 11. The sound inside of the housing 10 is transmitted to the outside of the housing 10 through the sound port 111. Specifically, a cross section of the sound port 111 may be in a rectangular or a circular shape, or may be in other shapes according to different usage environments. The middle cover 12 is a tubular structure. The lower cover 13 is a lid-shaped structure with an opening on one side thereof. Optionally, the cross section of the middle cover 12 is rectangular annular shaped. In other different usage environments, the shape of the cross section of the middle cover 12 also can be in other structures.

The flexible support 30 comprises a fixing portion 31 sandwiched between the middle cover 12 and the lower cover 13 and an elastic portion 32 extending from the fixing portion 31 into the accommodating cavity 101. The elastic portion 32 connects with the extension portion 2312 of the yoke 231.

In some embodiments, optionally, each of two ends of the main portion 2311 respectively extends to form the extension portion 2312 along a second direction perpendicular to the first direction. The first direction is a direction indicated by arrow x, and the second direction is a direction indicated by arrow y in FIG. 2. The flexible support 30 has two elastic portions 32 corresponding to the extension portions 2312. The extension portion 2312 and the corresponding elastic portion 32 are fixed in one-to-one, so that the flexible support 30 supports the magnetic circuit system 23 more stably. Specifically, two elastic portions 32 are respectively formed on two opposite sides of the flexible support 30 by bending and extending to an inner side of the accommodating cavity 101. The two elastic portions 32 are arranged spaced apart from each other. The elastic portion 32 is a hollow bending structure, so that the elastic portion 32 has a good elastic performance.

In some embodiments, the extension portion 2312 comprises a first extension portion 2312*a* bending and extending from the main portion 2311 to a direction of the flexible support 30 and a second extension portion 2312*b* bending and extending from the first extension portion 2312*a* and fixing to the elastic portion 32. More specifically, the second extension portion 2312*b* is in the shape of a flat plate, and is fixed to the elastic portion 32, so that the magnetic circuit system 23 can obtain a stable support even under a large-amplitude vibration.

In some embodiments, an outer surface of the housing 10 is level with an outer surface of the frame 21, so that the multifunctional electromagnetic transducer 100 has better integration, and the outer shape of the multifunctional electromagnetic transducer 100 is more regular, which is beneficial to mount the multifunctional electromagnetic transducer 100 with other members or electronic products. It is also convenient to transport and store the multifunctional electromagnetic transducer 100.

In some embodiments, an end of the middle cover 12 proximal to the lower cover 13 turns over into the accommodating cavity 101 to form a flange 121, and the fixing portion 31 is fixedly connected between the flange 121 and the lower cover 13. The flange 121 and the fixing portion 31 are both with an annular shape. so that the flexible support 30 can be more firmly fixed to the housing 1.

Figure 3:
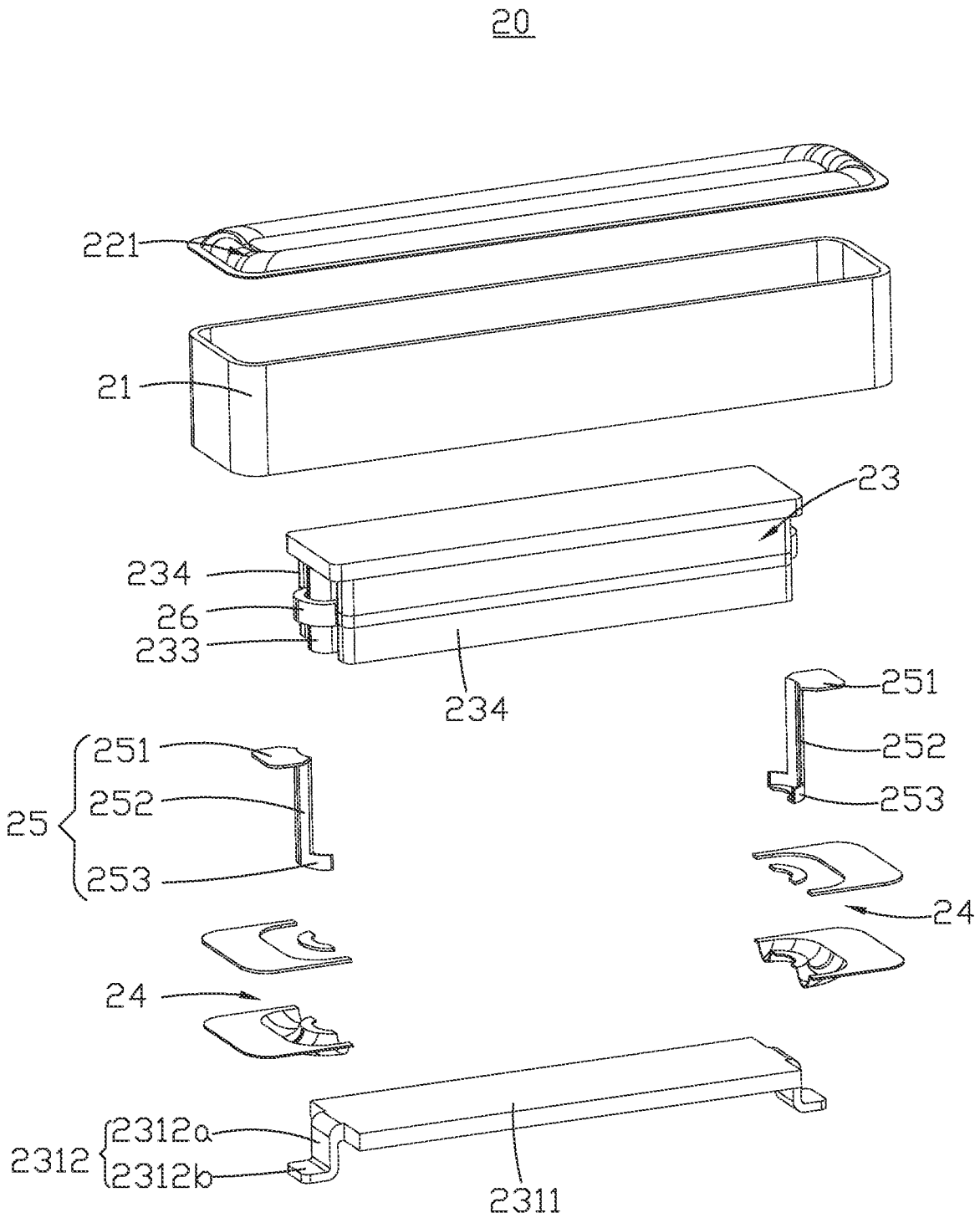
FIG. 3 is an exploded view of the speaker of the multifunctional electromagnetic transducer of FIG. 1.
Figure 4:
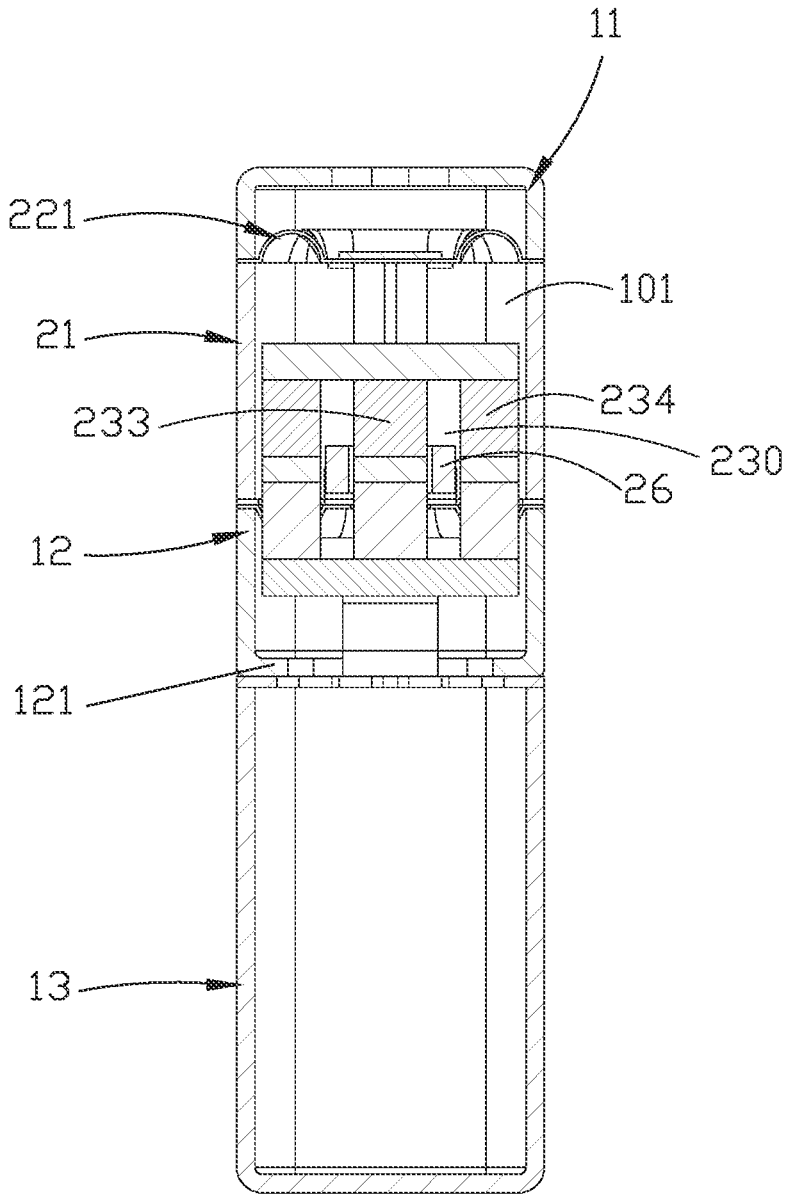
FIG. 4 is an illustrative cross-sectional view of the multifunctional electromagnetic transducer taken along line A-A of FIG. 1.
Figure 5:
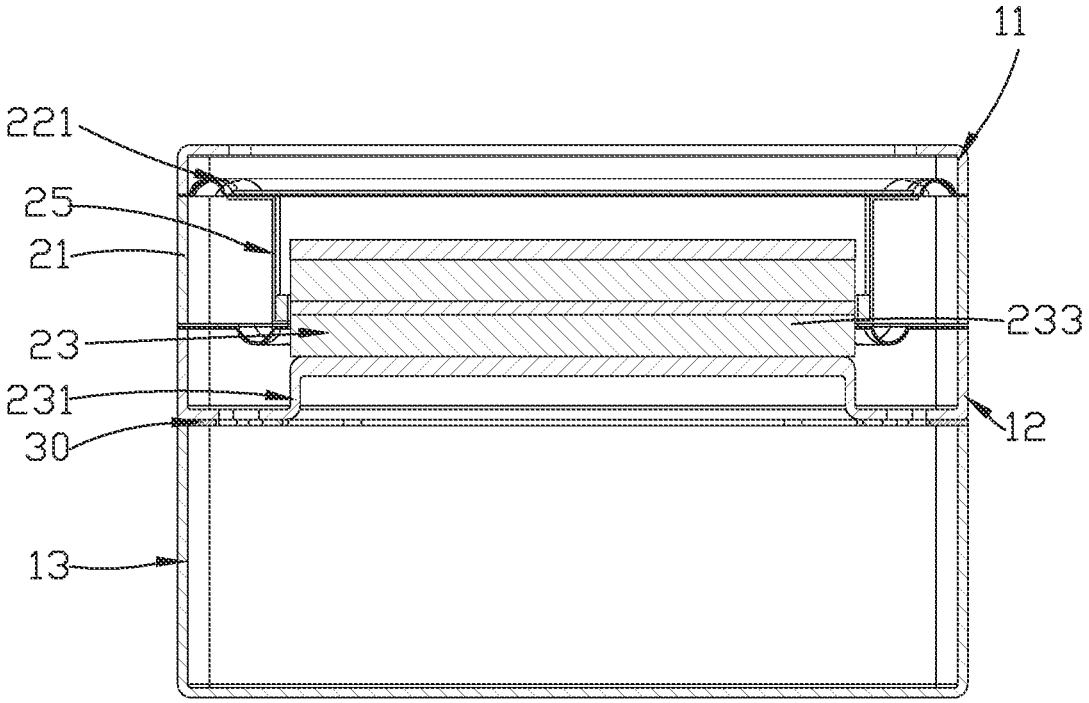
FIG. 5 is an illustrative cross-sectional view of the multifunctional electromagnetic transducer taken along line B-B of FIG. 1.

Referring to the FIGS. 3-5, in some embodiments, the vibration system 22 comprises a diaphragm 221 secured to the frame 21, an elastic assembly 24 spaced apart from the diaphragm 221 and mounted between the frame 21 and the middle cover 12, a connection support 25 connecting the diaphragm 221 and the elastic assembly 24, and a voice coil 26 fixing with the connection support 25. The magnetic circuit system 23 comprises a main magnet 233 and a plurality of auxiliary magnets 234. The auxiliary magnets 234 are arranged at two ends of the main magnet 233 and spaced apart from the main magnet 233 for forming a magnetic gap 230. The voice coil 26 at least partially locates in the magnetic gap 230.

The connection support 25 comprises a first bending portion 251 secured to the diaphragm 221, a second bending portion 252 bending and extending from the first bending portion 251 to the elastic assembly 24, and a third bending portion 253 bending and extending from the second bending portion 252 and secured to the elastic assembly 24. The voice coil 26 is fixed to a side of the third bending portion 253 away from the elastic assembly 24. In some embodiments, the first bending portion 251 is a flat sheet structure, the second bending portion 252 is an arc-shaped column structure bending from two sides to a middle part thereof, and the third bending portion 253 is a slot-like structure with an arc structure.

Comparing with the related art, the multifunctional electromagnetic transducer of present invention includes a housing providing with a sound port and a speaker fixed with the housing. The speaker includes a frame forming an accommodating cavity cooperatively with the housing, a vibration system supported on the frame and received in the accommodating cavity; and a magnetic circuit system received in the accommodating cavity driving the vibration system to vibrate along a first direction and generate sounds. The multifunctional electromagnetic transducer further includes a flexible support disposed on a side of the magnetic circuit system distal to the vibration system and secured to the housing. The magnetic circuit system is suspended in the accommodating cavity by the flexible support and moves along the first direction. In present invention, by setting the flexible support on the side of the magnetic circuit system away from the vibration system and fixing the flexible support to the housing, and the magnetic circuit system is suspended and fixed in the accommodating cavity through the flexible support, while the magnetic circuit system drives the vibration system to vibrate, the magnetic circuit system can also vibrate along the vibration direction of the vibration system, so that the multifunctional electromagnetic transducer of the present invention can provide stronger motor driving force and resistance, and both the starting time and the braking time are greatly shortened to achieve a better vibration experience.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A multifunctional electromagnetic transducer, comprising:

a housing providing with a sound port;

a speaker fixed with the housing, the speaker comprising:

a frame forming an accommodating cavity cooperatively with the housing;

a vibration system supported on the frame and received in the accommodating cavity; and a magnetic circuit system received in the accommodating cavity driving the vibration system to vibrate along a first direction and generate sounds;

a flexible support disposed on a side of the magnetic circuit system distal to the vibration system and secured to the housing;

wherein the magnetic circuit system is suspended in the accommodating cavity by the flexible support and moves along the first direction.

2. The multifunctional electromagnetic transducer as described in claim 1, wherein the magnetic circuit system comprises a yoke and a magnet assembly mounted on the yoke, the yoke comprising a main portion supporting the magnet assembly and an extension portion bending and extending from the main portion to the flexible support and secured to the flexible support, the magnetic circuit system fixed with the flexible support through the extension portion.

3. The multifunctional electromagnetic transducer as described in claim 2, wherein the housing comprises an upper cover mounted on a side of the frame, a middle cover mounted on an opposite side of the frame, and a lower cover fixed on a side of the middle cover distal to the upper cover, the flexible support comprising a fixing portion sandwiched between the middle cover and the lower cover and an elastic portion extending from the fixing portion into the accommodating cavity, the elastic portion connecting with the extension portion.

4. The multifunctional electromagnetic transducer as described in claim 3, wherein each of two ends of the main portion respectively extends to form the extension portion along a second direction perpendicular to the first direction, the flexible support having two elastic portions corresponding to the extension portions, the extension portion and the corresponding elastic portion fixed in one-to-one.

5. The multifunctional electromagnetic transducer as described in claim 3, wherein the extension portion comprises a first extension portion bending and extending from the main portion to a direction of the flexible support and a second extension portion bending and extending from the first extension portion and fixing to the elastic portion.

6. The multifunctional electromagnetic transducer as described in claim 3, wherein an outer surface of the housing is level with an outer surface of the frame.

7. The multifunctional electromagnetic transducer as described in claim 3, wherein an end of the middle cover proximal to the lower cover turns over into the accommodating cavity to form a flange, and the fixing portion is fixedly connected between the flange and the lower cover.

8. The multifunctional electromagnetic transducer as described in claim 7, wherein the flange and the fixing portion are both with an annular shape.

9. The multifunctional electromagnetic transducer as described in claim 1, wherein the vibration system comprises a diaphragm secured to the frame, an elastic assembly spaced apart from the diaphragm and mounted between the frame and the housing, a connection support connecting the diaphragm and the elastic assembly, and a voice coil fixing with the connection support, the magnetic circuit system comprising a main magnet and a plurality of auxiliary magnets, the auxiliary magnets arranged at two ends of the main magnet and spaced apart from the main magnet for forming a magnetic gap, the voice coil at least partially located in the magnetic gap.

10. The multifunctional electromagnetic transducer as described in claim 9, wherein the connection support comprises a first bending portion secured to the diaphragm, a second bending portion bending and extending from the first bending portion to the elastic assembly, and a third bending portion bending and extending from the second bending portion and secured to the elastic assembly, the voice coil fixing to a side of the third bending portion away from the elastic assembly.

* * * * *